US005993299A

United States Patent [19]

Chen et al.

[11] Patent Number: 5,993,299

[45] Date of Patent: Nov. 30, 1999

[54] METHOD AND APPARATUS OF UNINTERRUPTED SLURRY SUPPLY

[75] Inventors: Yu-Hao Chen, Hsinchu Hsien; Kwo-An Chiang, Hsinchu; Daniel Chiu, Hsinchu Hsien, all of Taiwan

[73] Assignee: United Silicon Incorporated, Taipei, Taiwan

[21] Appl. No.: 09/150,948

[22] Filed: Sep. 10, 1998

[30] Foreign Application Priority Data

Jun. 2, 1998 [TW] Taiwan ..... 87108603

[51] Int. Cl.[6] ..... B24B 1/00

[52] U.S. Cl. ..... 451/60; 451/446

[58] Field of Search ..... 451/446, 60, 99; 137/115.01, 115.14, 109, 625.29, 596.12, 599

[56] References Cited

U.S. PATENT DOCUMENTS

| | | | |
|---|---|---|---|
| 2,018,119 | 10/1935 | Brouse | 137/115.01 |
| 2,392,213 | 10/1946 | Cruzan | 137/115.01 |
| 3,683,562 | 8/1972 | Day | 51/131 |
| 4,784,295 | 11/1988 | Holmstrand | 222/148 |
| 5,467,797 | 11/1995 | Seetharaman et al. | 137/599 |
| 5,671,911 | 9/1997 | Piscitelli | 251/315.14 |
| 5,857,893 | 1/1999 | Olsen et al. | 451/5 |
| 5,885,134 | 3/1999 | Shibata et al. | 451/41 |

*Primary Examiner*—Eileen P. Morgan
*Assistant Examiner*—Dung Van Nguyen
*Attorney, Agent, or Firm*—Thomas, Kayden, Horstemeyer & Risley

[57] ABSTRACT

A method and an apparatus of uninterrupted slurry supply. A plurality of polishers are provided. A slurry supply system comprises a slurry supply source, a plurality of valve boxes having a corresponding number as the polishers, a plurality of pipes to connect the valve boxes and the slurry supply source and the valve boxes and the polishers, a plurality of bypasses to connect between an inlet and an outlet of each of the valve boxes, and a plurality elbow type manually controlled three-way valve at a plurality of joints of the pipes and the bypasses. A slurry is supplied from the slurry supply source. A flowing direction of the slurry is selected by adjusting the three-way valve to supply the polishers for polishing.

9 Claims, 4 Drawing Sheets

METHOD AND APPARATUS OF UNINTERRUPTED SLURRY SUPPLY

CROSS-REFERENCE TO RELATED APPLICATION

This application claims priority benefit of Taiwan application Ser. No. 87108603, filed Jun. 2, 1998, the full disclosure of which is incorporated herein by reference.

BACKGROUND OF THE INVENTION

1. Field of the Invention

The invention relates to a method and an apparatus of supplying slurry during chemical-mechanical polishing (CMP), and more particular, to an improved design of a slurry supply system by installing a bypass of a valve box therein.

2. Description of the Related Art

For a very large scale integration (VLSI) or even an ultra large scale integration (ULSI), chemical-mechanical polishing is the only technique that provides global planaration.

Referring to FIG. 1A and FIG. 1B, a conventional chemical-mechanical polisher comprises a polishing table 10, a polishing pad 12 and a polishing head on the polishing table 10. During polishing, the wafer 16 carried by the polishing head 14 is facing down. The polishing is performed with slurry supply 18 as shown in the figure.

In FIG. 2, a chemical-mechanical polishing slurry supply system designed by MEGA is shown. Being blended by reacting chamber 206 and distributed by distributing chamber 205, the slurry is flowing through a thicker pipe 207 to valve boxes 203 and 204 connected in serial. By applying Bernoulli's law, the slurry is then flowing through a thinner pipe 208 to various polisher 201 and 202. In a conventional slurry supply system, five valve boxes are disposed in serial, that is, a conventional slurry supply system can supply five polisher for polishing at a time by disposing valve boxes in serial.

In FIG. 2, valve boxes 203 and 204 are disposed on the bypass of slurry. Since the slurry contains a large amount of particles, a dead leg is very likely to occur at the corner of the pipe to stock the pipe. In addition, in the above slurry supply system, the valve boxes are connected in serial. Once one of them is out of order or stocked, the rest of the valve boxes are affected, the whole system is down, and the polishing has to be broken off.

SUMMARY OF THE INVENTION

It is therefore an object of the invention to provide a method and an apparatus to supply slurry uninterruptedly. The possibility of causing a dead leg is effectively suppressed. During chemical-mechanical polishing, the slurry is flowing into the polisher fluently. In case that one of the valve boxes is out of order or stocked, the rest of the polisher can still perform polishing without any impact.

To achieve these objects and advantages, and in accordance with the purpose of the invention, as embodied and broadly described herein, the invention is directed towards a method and an apparatus of uninterrupted slurry supply. A plurality of polishers are provided. A slurry supply system comprises a slurry supply source, a plurality of valve boxes having a corresponding number as the polishers, a plurality of pipes to connect the valve boxes and the slurry supply source and the valve boxes and the polishers, a plurality of bypasses to connect between an inlet and an outlet of each of the valve boxes, and a plurality elbow type manually controlled three-way valve at a plurality of joints of the pipes and the bypasses. A slurry is supplied from the slurry supply source. A flowing direction of the slurry is selected by adjusting the three-way valve to supply the polishers for polishing.

It is to be understood that both the foregoing general description and the following detailed description are exemplary and explanatory only and are not restrictive of the invention, as claimed.

DESCRIPTION OF THE PREFERRED EMBODIMENTS

Figure 1A:
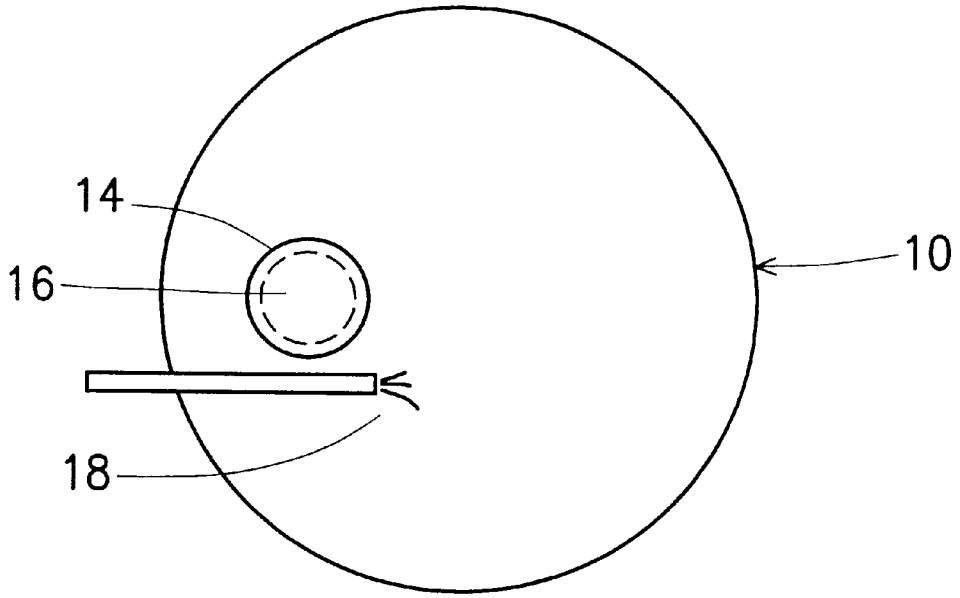
FIG. 1A (PRIOR ART)
FIG. 1A shows a top view of a chemical-mechanical polisher.
Figure 1B:
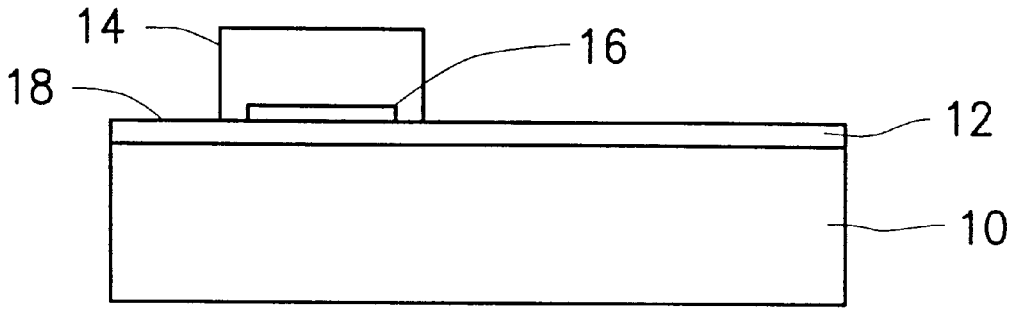
FIG. 1B (PRIOR ART)
FIG. 1B shows a side view of a chemical-mechanical polisher.
Figure 2:
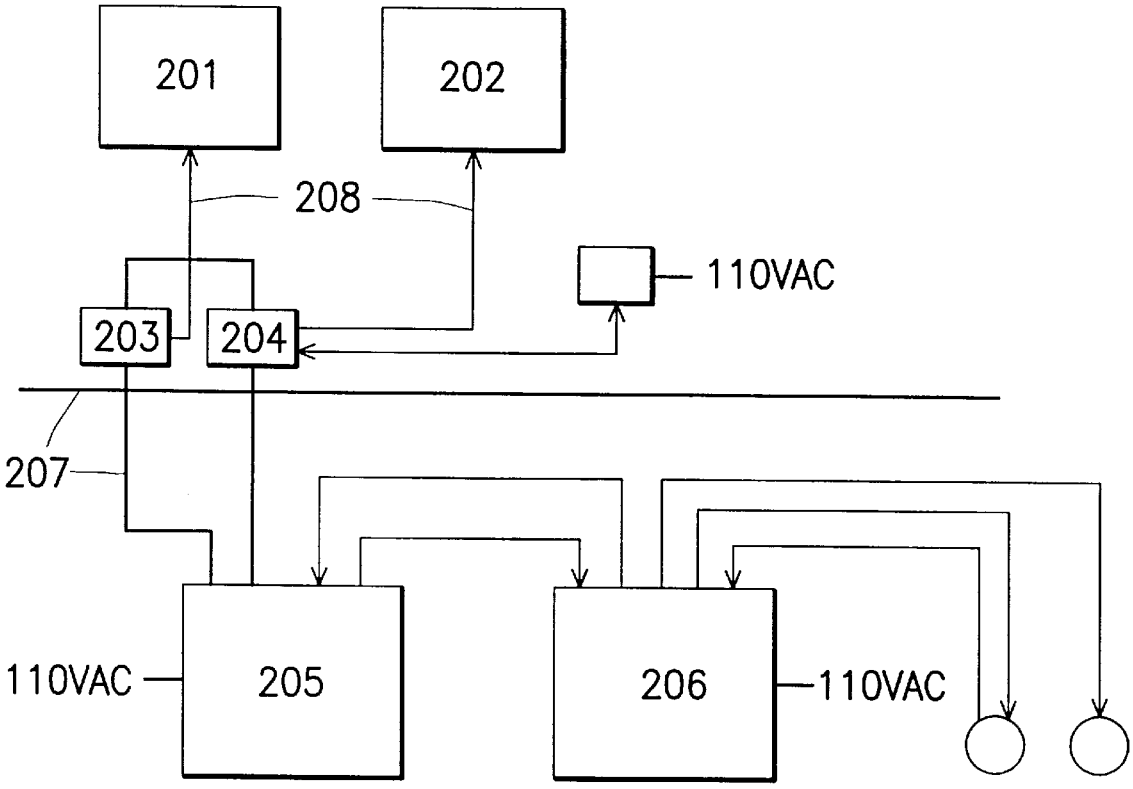
FIG. 2 (PRIOR ART)
FIG. 2 shows a conventional slurry supply system designed by MEGA.
Figure 3A:
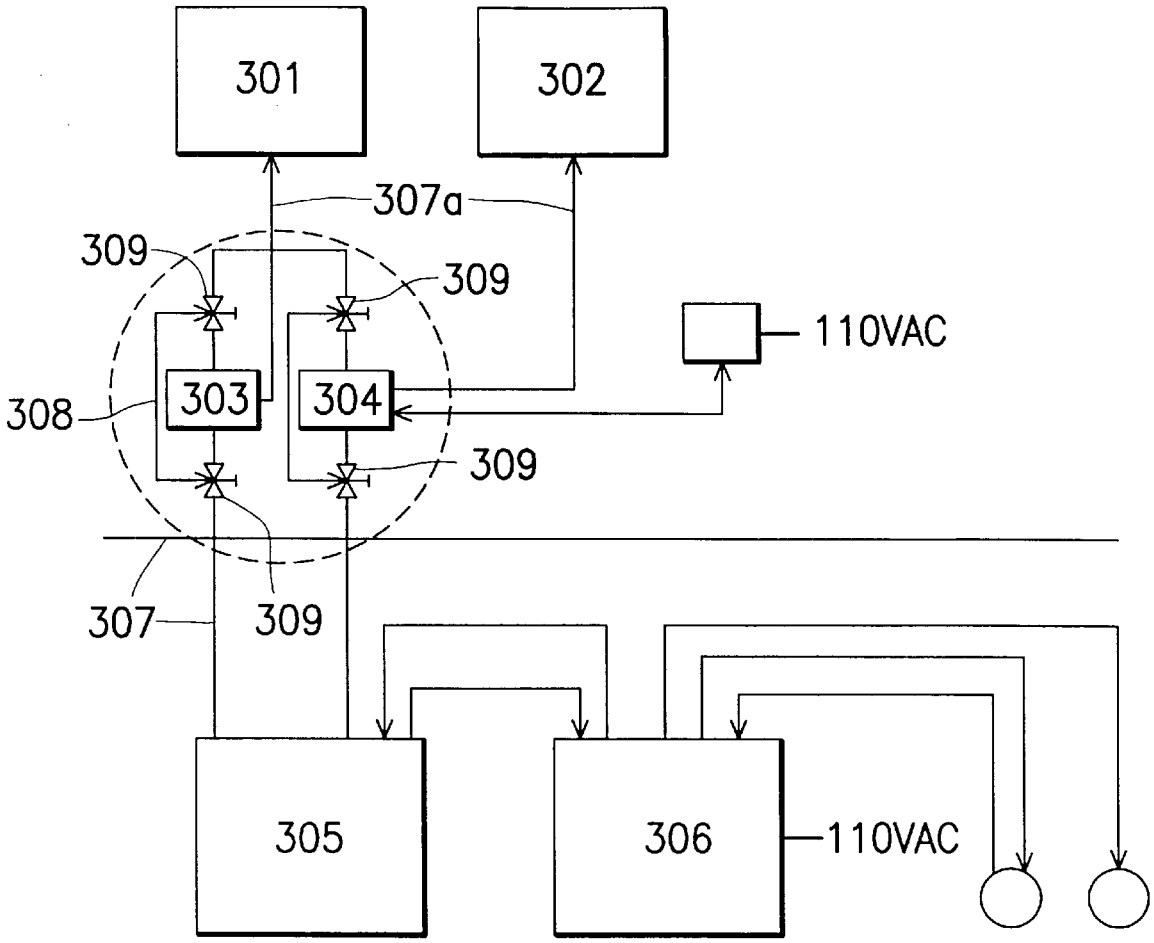
FIG. 3A shows an improved slurry supply system in a preferred embodiment according to the invention.
Figure 3B:
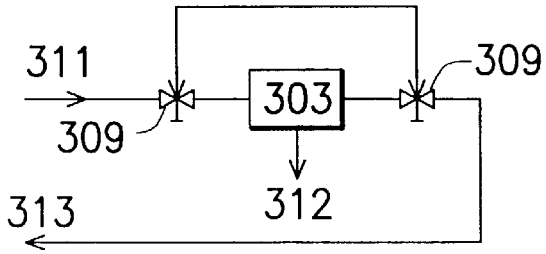
FIG. 3B is an enlarged view of the slurry flow through the valve box and the pipe in FIG. 3A.

In FIG. 3A to FIG. 3B, a preferred embodiment according to the invention is shown. In a slurry supply system according to the invention, a three-way valve is used and installed at the joint of the pipe and the bypass. The structure of the three-way valve is shown in FIG. 4.

Referring to FIG. 3A, being blended with perhydrol and distributed by chambers 305 and 306 respectively, the slurry is flowing through a pipe 307 to various valve boxes 303 and 304, or to bypass 308. The slurry is then flowing through pipe 307*a* to various polisher 301 and 302. The caliber of pipe 307 and 307*a* is the same, for example, about ⅝". The difference from the conventional structure is that a manually controlled three-way valve 309 is installed at the joint of the pipe 307 and the bypass 308. With the manually controlled three-way valve 309, the flowing direction of slurry can be controlled as required. In case that one of the valve boxes is out of order or stocked, the slurry can be diverted to flow through bypass. The other valve boxes for supplying slurry to the other polishers are not affected. As mentioned in the prior art, a slurry supply system can normal supply for five polishers at a time. In the invention, in case that one of the five valve boxes is down, there are still four polishers working normally.

Referring FIG. 3B, an enlarged view of the dash-line circle is shown. The arrow 311 represents the slurry supplying direction. The flowing direction of the slurry from the valve box 313 to the polisher is shown as the arrow 312. The returning flow of the slurry is directed as the arrow 313. As shown in the figure, for either flowing in or out of the valve box 303, the slurry has to be flowing through the three-way valve 309. The disposition of the three-way valve 309 is at the joint of the pipe and the bypass, that is, the comer part in the conventional slurry supply system. Therefore, by disposing a three-way valve instead of a comer structure, the dead leg and stock occurs in the conventional system is prevented.

Figure 4:
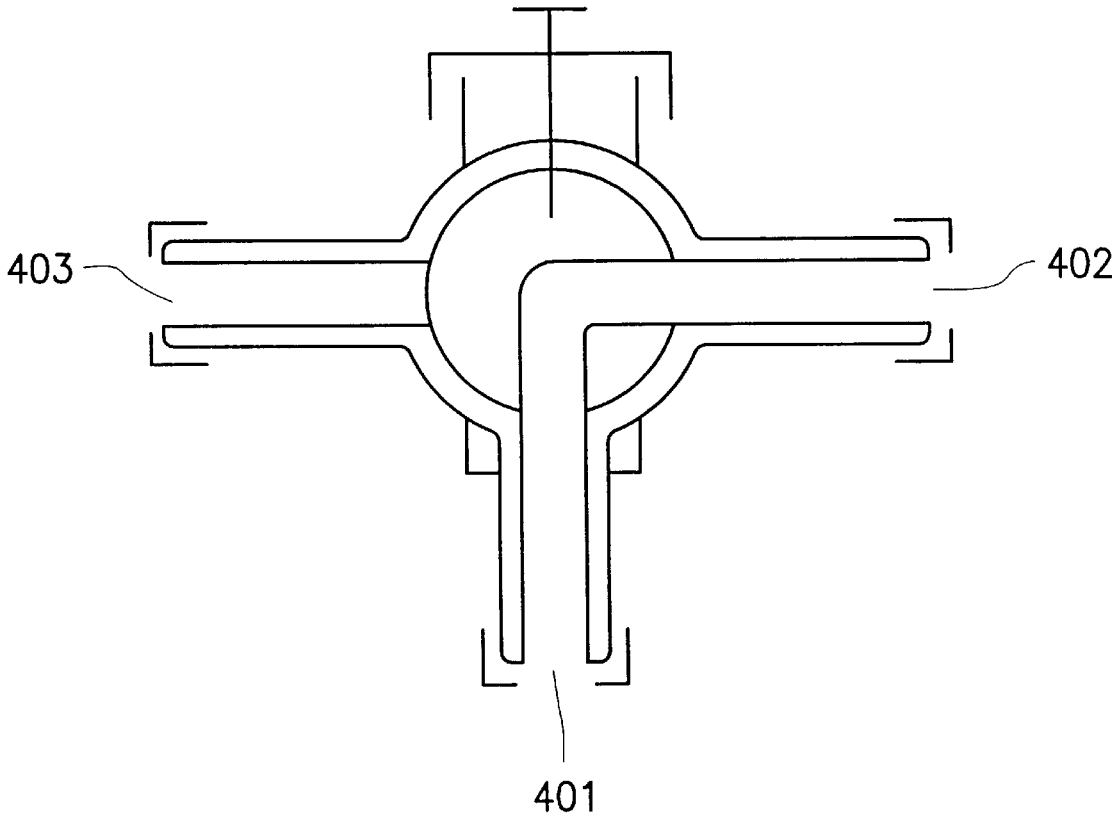
FIG. 4 shows a three-way valve used in FIG. 3A and FIG. 3B.

The manually controlled three-way valve is shown in FIG. 4. An elbow type valve is adapted in the invention. The elbow type valve has three conducting ways 401, 402, and 403. In the center of the valve, a friction ball is installed. By the movement of the friction ball, the slurry is directed towards different directions.

It is therefore a characteristic of the invention to install a manually controlled three-way valve at the joint of the pipe and the bypass. An elbow type three-way valve is in use in the invention, so that the possibility of causing a dead leg or a stock is suppressed effectively. In addition, with the installation of a manually controlled three-way valve, the flowing direction of the slurry is controlled as required. In case that one of the supply for a polisher, for example, a valve box or a pipe, is out of order or stocked, though the valve boxes are connected in serial, the other polishers can work normally without any impact.

Other embodiment of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A method of uninterrupted slurry supply, wherein a plurality of polishers are provided, comprising the steps of:

providing a slurry supply system comprising a slurry supply source, a plurality of valve boxes having a corresponding number as the polishers, a plurality of pipes to connect the valve boxes and the slurry supply source and the valve boxes and the polishers, and a plurality of bypasses to connect between an inlet and an outlet of each of the valve boxes;

providing a plurality of elbow type manually controlled three-way valves at a plurality of joints of the pipes and the bypasses;

providing a slurry from the slurry supply source; and selecting a flowing direction of the slurry by adjusting the three-way valve to supply slurry to the polishers for polishing.

2. The method according to claim 1, wherein the number of the polishers are from 1 to 5.

3. The method according to claim 2, wherein the number of the valve boxes are from 1 to 5.

4. The method according to claim 1, the caliber of the pipe is about ⅝".

5. An apparatus of uninterrupted slurry supply, wherein a plurality of polishers are provided, comprising:

a slurry supply system, comprising:

a slurry supply source, to supply a slurry;

a plurality of valve boxes having a corresponding number as the polishers;

a plurality of pipes to connect the valve boxes and the slurry supply source, and the valve boxes and the polishers;

a plurality of bypasses to connect between an inlet and an outlet of each of the valve boxes; and a plurality elbow type manually controlled three-way valve at a plurality of joints of the pipes and the bypasses; wherein the slurry flowing through the pipes are directed by the three-way valve to the polishers for polishing.

6. The apparatus according to claim 5, wherein the number of the polishers are from 1 to 5.

7. The apparatus according to claim 6, wherein the number of the valve boxes are from 1 to 5.

8. The apparatus according to claim 5, the caliber of the pipe is about ⅝".

9. An apparatus of uninterrupted slurry supply, wherein a plurality of polishers are provided, the apparatus comprising:

a slurry supply system, comprising:

a slurry supply source, to supply a slurry;

a plurality of valve boxes, having a valve box corresponding to each of the polishers;

a plurality of pipes to connect the valve boxes and the slurry supply source, and a plurality of pipes to connect the valve boxes and the polishers;

a plurality of bypasses to connect between an inlet and an outlet of each of the valve boxes; and a plurality elbow-type manually controlled three-way valves at a plurality ofjoints of the pipes and the bypasses, wherein the controlled three-way valves are switched according a flowing status of the slurry to the polisher for polishing.

* * * * *